United States Patent [19]

Tornero

[11] Patent Number: 4,613,106

[45] Date of Patent: Sep. 23, 1986

[54] MECHANICAL ADJUSTABLE COLUMN

[76] Inventor: Lino E. Tornero, 629 Joyner St., Greensboro, N.C. 27403

[21] Appl. No.: 727,142

[22] Filed: Apr. 25, 1985

[51] Int. Cl.[4] ..... F16M 11/00

[52] U.S. Cl. ..... 248/405; 248/417; 297/347; 74/39

[58] Field of Search ..... 248/405, 406.1, 406.2, 248/417, 416; 297/347, 348, 339; 74/39, 89.15

[56] References Cited

U.S. PATENT DOCUMENTS

| | | | |
|---|---|---|---|
| 2,329,697 | 9/1943 | Davies | 248/417 |
| 3,727,871 | 4/1973 | Harper | 248/406.1 |
| 3,923,280 | 12/1975 | Good | 248/405 |
| 4,139,175 | 2/1979 | Bauer | 297/347 X |
| 4,285,488 | 8/1981 | Hancock | 248/405 |
| 4,315,613 | 2/1982 | Godwin et al. | 248/406.2 |
| 4,394,001 | 7/1983 | Wisniewski | 248/406.2 X |
| 4,493,469 | 1/1985 | Holobaugh | 248/406.1 |

*Primary Examiner*—Ramon O. Ramirez

*Attorney, Agent, or Firm*—Charles R. Rhodes; Judith E. Garmon

[57] ABSTRACT

An adjustable support column for chairs, stools, tables or other furniture items in which a support tube telescopically receives a mounting cylinder. The mounting cylinder is seated on a diamond threaded support rod in the support tube by means of one or more drive nuts and a locking nut. A clutch selectively releases the locking nut to permit longitudinal adjustment of the mounting cylinder relative to the support tube. The diamond threaded support rod is connected to a power spring which stores energy as the support rod is rotated in one direction to cause a return of the support rod to its initial position when the locking nut is released.

19 Claims, 6 Drawing Figures

MECHANICAL ADJUSTABLE COLUMN

BACKGROUND OF THE INVENTION

The present invention relates in general to mechanically adjustable columns, such as those used for the stepped height adjustment of chairs and furniture in general; specifically to new and useful improvements in the art with emphasis on reliability, aesthetic appearance, ease of manufacture, and competitiveness with existing devices.

Conventional adjustable columns of the type thus far described have generally fallen into two categories: those capable of storing energy by the use of compressible gases such as the commonly known "Gas Springs," and those which require considerable effort or manipulation such as those employing long screw devices, purely hydraulic means or purely clutching means. Gas springs usually provide the required effect yet are difficult to manufacture due to the close tolerances involved, are prone to leakage of the compressed gases and oil, cannot be repaired upon failure, and under certain circumstances can post safety hazards. Mechanical devices usually consist of a long screw interposed and engaged between a seat and a base in such a way that height adjustment can only be achieved by turning one relative to the other in order to reduce the effective height of the article of furniture. These are rather heavy and cumbersome devices unsuitable by today's standards.

SUMMARY OF THE INVENTION

One feature of this invention is the ability of the device to store energy in a power spring, a type of spring to provide power for the return stroke during any adjustment cycle. The power spring in question is easily concealed within the device, easily exchangeable, and stackable to provide for a wide range of operating conditions or loads.

Another feature of the invention is a braking or clutching means, to provide for the voluntary and infinite adjustment of height within its useful stroke. The clutching means is so designed so as to not interfere with the swiveling action of the device and article of furniture. The clutching mechanism is so designed in relation to other elements of the device that it can be adjusted without required turning or swiveling of the device and piece of furniture.

Another feature of the invention is an adjusting mechanism to provide for adjustment of the tension and sensitivity of the clutching mechanism, and at the same time provide accessibility to the interior of the device should the occasion arise.

Another feature of the device is an actuating pin protruding from an upper portion of the mounting cylinder to provide for the activation of the clutching mechanism from outside the device, and easily operable for example by means of a lever and fulcrum mechanism installed in a concealed location on the article of furniture.

Another feature of the invention is what is sometimes referred to in the industry as a "Diamond Thread Screw" and is commonly associated with "Ball Reversers" and "Reciprocating Actuators." The diamond thread screw provides in essence for two directionally opposing threads on the same screw or rod. When used with matching lock nuts it is possible to lock its rotation about its longitudinal axis by the friction between the matching nuts which is controlled by the aforementioned activation mechanism. A third or drive nut arbitrarily engaged with either thread of the screw is selectably made stationary in relation to the casing of the mounting cylinder at the same time the lock nuts are released thus forcing the screw to rotate and wind the power spring during a compression stroke. A more detailed explanation of this feature will be provided in the specification.

Yet another feature of the invention is the provision of frustoconical or tapered portions on the upper end of the mounting cylinder and lower end of the support tube for rapid and secure installation of the device in an article of furniture provided with matching female type tapered elements. In this manner the device itself is the support column for the article of furniture or the like.

Another feature of the invention is the provision of a shock absorbing mechanism designed to absorb sudden loads associated with seating and other useful articles, and consisting of a set of bellevile washers or spring washers, internal to the device.

In order to understand the features of the invention the following drawings have been provided:

DETAILED DESCRIPTION OF A PREFERRED EMBODIMENT

Figure 1:
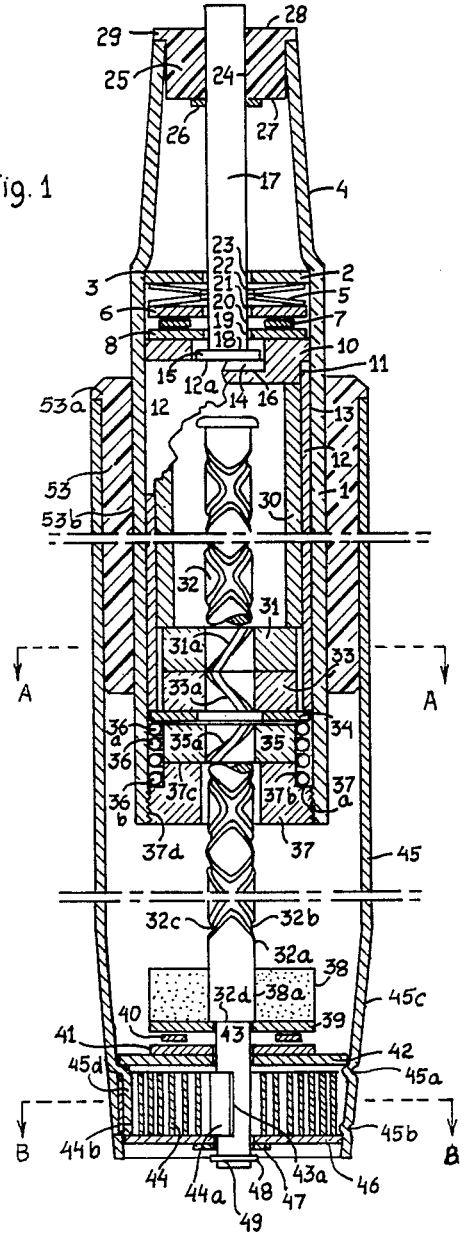
FIG. 1 is a longitudinal cross-section of the device of the present invention, some elements such as the diamond thread screw are shown in full view or partially cross-sectioned for clarity.
Figure 3:
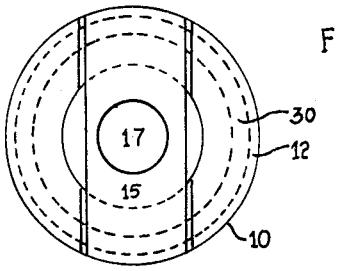
FIG. 3 is a sectional view taken substantially along lines 3—3 in FIG. 1 and illustrating an annular member associated with the clutching mechanism.
Figure 4:
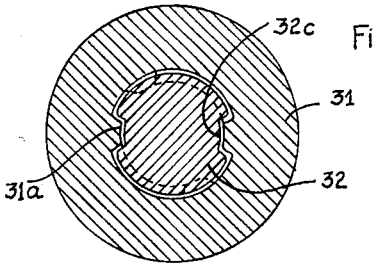
FIG. 4 is a sectional view taken substantially along lines 4—4 in FIG. 1 depicting the manner of engagement between one of the lock nuts and the diamond thread support rod.

Referring to FIG. 1, the adjustable support column includes a mounting cylinder 1 in which are contained or retained elements of the device, among which an annular metal wall or washer 2 is abutted against the internal periphery 3 of an abutment created by the diametric constriction or taper 4 on the upper portion of cylinder 1. A set of belleville washers 5 are positioned between said washer 2 and a bearing race 6 so as to provide shock absorbing means to the device. Bearing race 6 is located below said belleville washers. A thrust bearing 7 is placed in contact with said race 6 and another race 8 completes the swivel mechanism and is such that its external diameter is less that the internal diameter of the cylinder 1 to provide for the free rotation of race 8 within said cylinder 1.

A die cast or machined metal activating member 10 supports said race 8 and exists in longitudinal and axial alignment within the interior of cylinder 1. The activating member 10 includes a shoulder 11 for the installation of a metal tube 12, axially slidable between said shoulder 11 and the internal wall 13 of cylinder 1. Member 10 exhibits a groove 14 radially extending across its diameter and receiving in sliding contact therewith a metal stamping 15. The metal stamping 15 is capable of axial movement within groove 14 limited by the base 16 of groove 14. Said metal stamping thus engages the upper end periphery 12*a* of tube 12 so as to cause the displacement of said tube 12 relative to said member 10 upon the application of an external force on pin 17. Pin 17 is in concentric and axial alignment to the longitudinal axis of the device and abutted on its lower end 18 against the upper portion of stamping 15. Pin 17 extends through the bore 19 of race 8, the bore 20 of thrust bearing 7, bore 21 of race 6, bore 22 of belleville washers 5, bore 23 of washer 2 and bore 24 of an end plug 25. Pin 17 is prevented from exiting the device by means of a spring clip 26 which provides a stop against the lower portion 27 of plug 25. Pin 17 extends upwardly for some distance beyond the upper face 28 of plug 25.

Plug 25 is made of nylon or some such elastomeric material to provide antifriction means and guidance for said pin 17 and includes an external diameter larger than that of the internal diameter of cylinder 1 to provide a friction fit. Plug 25 is inserted into the constricted end of cylinder 1 so that a lip 29 on its upper periphery abuts against the wall of cylinder 1.

Sleeve or tube 30 in axially concentric alignment and internal to tube 12 has an outer diameter slightly less than the internal diameter of said tube 12 so as to permit the axial displacement of said tube 12 relative to said tube 30. Tube 30 is abutted against the lower surface of member 10 on one end, and against the upper surface of nut 31 at the other end. Nut 31 is a die cast metal nut which exhibits a long thread lead 31*a* so designed as to be able to engage with a corresponding thread groove on a diamond thread screw or support rod 32. Nut 31 is thereby positioned in sliding contact with the lower end of tube 30 and the internal wall of tube 12. A nut 33, similar to nut 31 but exhibiting a long thread lead 33*a* opposing in direction that of nut 31, exists directly below and in sliding contact with the lower surface of nut 31 and the internal surface of tube 12. Thread 33*a* engages a corresponding thread groove on diamond thread screw 32.

A metal washer 34 is abutted in sliding contact against the lower surface of nut 33 and tube 12 on a plane common to both surfaces and its internal bore is substantially larger than the diameter of diamond thread screw 32 so as to allow rotation of the screw 32 therein.

A drive nut 35 exists in threaded engagement with diamond head screw 32 by means of a long thread lead 35*a* the direction of which opposes the direction of either thread 31*a* or 33*a* but is selected so as to cause the rotation of diamond thread screw 32 in a predetermined direction. The external diameter of said drive nut 35 is substantially smaller than the internal diameter of compression spring 36. The upper surface of said nut 35 is normally separate and free of contact with the lower surface of washer 34 except upon activation of the clutch device which shall become clear during a subsequent description of the method of operation.

Compression spring 36 exists in a slightly compressed manner exerting pressure on its last upper coil 36*a* against a portion of the lower surface of washer 34 and on its last lower coil 37*b* against an abutment 37*a* on plug 37 to normally bias washer 34 in spaced relation to drive nut 35. Said plug 37 exhibits a shoulder 37*b* creating the abutment 37*a* to provide guidance to said spring 36. The upper surface 37*c* of plug 37 provides support and friction means for the lower surface of nut 35. A thread 37*d* is provided on a portion of the external periphery of plug 37 so as to engage a corresponding thread on the internal surface of the lower end of cylinder 1. Plug 37 thus retains all device elements internal to cylinder 1 and provides a degree of adjustment for the spring 36 and relative positioning of nut 35.

Diamond threaded support rod or screw 32 is aligned with the longitudinal axis of cylinder 1, passing without interference through a bore 37*e* in plug 37 in such a way as to permit the axial displacement of said plug 37 relative to said diamond thread screw 32. The diamond thread screw 32 subsequently engages drive nut 35 in the aforementioned manner, passes without interference through the bore of washer 34, engages locking nuts 33 and 31 and extends for a distance past the upper surface of nut 31. By said arrangement of nuts 31, 33 and 35, said diamond thread screw 32 is maintained in a substantially concentric alignment to the longitudinal axis of cylinder 1. Further, the mounting cylinder through the nuts 31, 33, and 35 is able to axially reciprocate along the support rod 32. It should be here pointed out and appreciated that while two drive nuts 31,35 are disclosed in the preferred embodiment, one would suffice.

Figure 5:
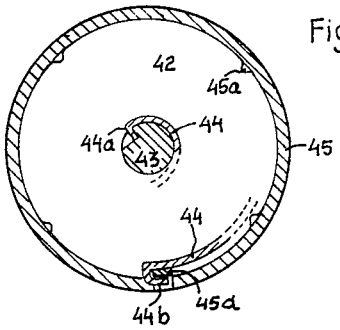
FIG. 5 is a sectional view taken substantialy along lines 5—5 of FIG. 1 and illustrating the power spring and screw showing the engagement of the outer casing of the device with the spring and the engagement of the spring with the diamond thread screw.

The diamond thread screw or support rod 32 further extends for an arbitrary distance past the lower end or surface of cylinder 1 and plug 37 and includes on its lower end a brake or end point 32*a* of its opposing thread grooves 32*b* and 32*c*. Therebelow diamond thread screw 32 exhibits no thread grooving and thus becomes a rod which extends in sliding contact within the bore 38*a* of annular elastomeric shock absorbing means 38. The annular shock absorbing means 38 abuts against the upper surface of a bearing race 39, the bearing race 39 itself is seated against the underside of a shoulder 32*d* created by a reduction of the diameter of diamond thread screw 32. The reduced diameter length of diamond thread screw 32 extends in sliding contact through the bores of bearing race 39, thrust bearing 40, bearing race 41 and support washer 42. The diamond thread screw reduced diameter portion 43 thereof extends below the lower surface of support washer 42 and becomes an arbor upon which a power spring 44 is engaged by means of a notch 43*a* formed on the reduced diameter 43 and a bend 44*a* on the last portion of the internal end of spring 44. The aforementioned structure is best understood referring at this point to FIG. 5.

Support washer 42 is effectively abutted in its lower surface against downward axial displacement by stakes 45*a* of which an arbitrary number are radially interspaced along the support tube 45 on a plane perpendicular to the longitudinal axis of said support tube 45. A stamped hook 45*d* on an arbitrary location below the plane of said stakes 45*a* on the wall of support tube 45 engages the external end 44*b* of the spring 44 so as to impede the gyration or movement of said spring 44 relative to the cross-sectional circumference of said support tube 45.

The upper surface of a washer 46 is prevented from upward movement by abutment against stakes 45*b* of which an arbitrary number are radially interspaced along the inner wall of support tube 45. A spacing washer 47 is located in rotatable relation with the lower surface of washer 46 and engages in sliding contact the reduced diameter portion 43 of support rod 32. A spring retaining means or snap ring 48 is installed in a groove 49 on the end of shoulder 43 and thus prevents the involuntary ejection of the elements thus far described from the interior and engagement with support tube 45.

Figure 2:
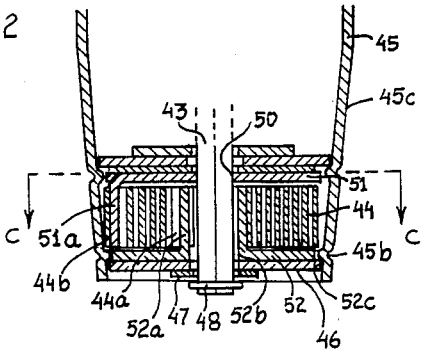
FIG. 2 is a longitudinal cross-section of the lower end of the support tube illustrating an alternative power spring installation method.
Figure 6:
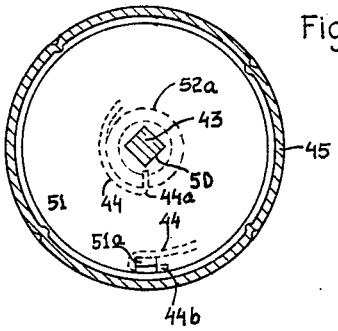
FIG. 6 is a sectional view similar to FIG. 5 except showing the alternative method described in FIG. 2.

FIG. 2 shows an alternative method for the installation of a power spring 44 within the lower portion of support tube 45. In this case the reduced diameter portion 43 of diamond thread screw 32 exhibits essentially a square cross-section as shown in FIG. 6, although said cross-section may in practice differ so long as it effectively engages a matching bore 50 on a stamped bearing member 51. Thus rotation of support rod 32 induces a rotation of washer 51. The stamped washer 51 exists in sliding contact with the lower surface of washer 42 and the interior surface of support tube 45 and includes a tab 51*a* bent downwardly from washer 51 and extending thus for a distance appropriate for the engagement of the external end 44*b* so as to permit the winding of spring 44 upon a rotation of diamond thread screw 32. The internal end 44*a* of spring 44 is engaged on short tube 52*a* which is soldered, welded or otherwise made integral with a washer to form a bearing member 52. Said tube 52*a* includes an internal bore 52*b* with a diameter substantially larger than that of shoulder 43 so as to allow for the free gyration of said shoulder 43 within said tube bore 52*b*. The bearing member 52 also exhibiting around its circumference a series of notches 52*c* made to correspond in number to an equal number of staked protrusions 45*b* and in such a way that their mutual engagement prevents the gyration of bearing 52 relative to the axis of support tube 45. The washer 46 engages stakes 45*a* and is in sliding contact with the lower surface of washer 52 so as to retain the spring 44 and washers 51 and 52 within the lower portion of support tube 45. A washer 47 and snap ring 48 ensures the proper retention of said spring assembly elements.

Support tube 45 contains within its bore a guide bushing 53 near the upper end and includes a lip 53*a* to prevent its axial displacement. A bore 53*b* on said guide bushing 53 is reamed so as to receive cylinder 1 and thus provide for the free axial displacement of cylinder 1 relative to support tube 45 upon the actuation of the device.

The device is installed on a chair or article of furniture in such a way that the upper taper 4 frictionally engages a matching frustoconical bore on the underside of said chair or article of furniture and the lower taper section 45*c* of support tube 45 also frictionally engages a matching frustoconical bore on the chair base. The device thus comprises a support and connection column between said chair parts. A lever mechanism is provided on the underside of said chair or artical of furniture so as to be able to axially displace pin 17 relative to cylinder 1.

Upon placing a load, such as the weight of a person upon said chair, and should it become necessary to adjust the chair or seat height, the person would manually and indirectly activate said pin 17 by means of said activating lever. The chair or article of furniture remains stationary and maintains its height unless said lever is activated, that is, the device is normally under a locked position.

Said normally locked position is due to the clutching assembly. In said normally locked position spring 36 exerts considerable axial force upon washer 34 against tube or sleeve 30, causing nuts 31 and 33 to become frictionally engaged. Because nuts 31 and 33 exhibit opposing threads, said frictional engagement between said nuts 31 and 33 is sufficient to impede the rotation in any direction of diamond thread screw 32. Thus cylinder 1 is incapable of axial diplacement relative to support tube 45 and the normally locked position of the device is thus maintained. If it is needed to adjust the height of the chair or article of furniture, voluntary activation of the lever and therefore axial displacement of pin 17 in turn causes the axial displacement of tube 12 and washer 34 relative to cylinder 1. This causes spring 36 to compress, relieving the force on the lower surface of nut 33 and thus allowing the frictional disengagement of sleeve 30, nuts 31 and 33, and the diamond thread screw 32 is thus free to rotate about its longitudinal axis. Simultaneously, as nuts 31,33 are frictionally disengaged by the axial displacement of tube 12 against washer 34, the lower surface of washer 34 frictionally engages the upper surface of nut 35 so as to impede the gyration of said nut 35 about its longitudinal axis and relative to cylinder 1. A similar frictional engagement occurs between the lower surface of nut 35 and the upper surface of plug 37 and thus nut 35 is effectively frictionally engaged within cylinder 1. Therefore, while the clutching assembly comprised by nuts 31 and 33 permits the free rotation of diamond thread screw 32 about its longitudinal axis during the adjusting cycle, nut 35 causes the rotation of said diamond thread screw 32 about its longitudinal axis, as the load or weight of the person forces the axial displacement of cylinder 1 (and therefore of nut 35) within bushing 53 and relative to the longitudinal axis of support tube 45 and with the consequent winding of power spring 44, storing a certain amount of energy in said spring 44. If the activating lever and therefore pin 17 is now allowed to return to the original locked position causing the frictional engagement of nuts 31 and 33 and relieving the frictional engagement of nut 35, washer 34, and plug 37, said stored energy or tension within spring 44 will remain there until the activating lever is again operated upon and the chair height remains stationary in said lower position as the device is in a locked position. Should it be desired to raise the chair height, operation of the activating lever and therefore pin 17 while removing the load or weight of the person on the chair will repeat the aforementioned cycle and disengage the clutching assembly, that is, nuts 31 and 33 will disengage allowing the diamond thread screw to rotate within the thread bore of nut 35, said nut 35 then being in frictional engagement with plug 37 and cylinder 1. The energy stored in spring 44 will cause diamond thread screw 32 to rotate, and engagement fits thread groove with the internal bore thread 35*a* of nut 35 will result in the axial displacement of nut 35 and cylinder 1 within bushing 53 and relative to support tube 45. Thus the chair is raised and the cycle repeated as desired.

Swiveling of the chair and therefore of cylinder 1 about the longitudinal axis of the support tube 45 is possible at any time, without fear of winding the spring 44 since in a locked position the chair sat and cylinder 1 rest upon race 6 and thrust bearing 7 and is frictionally independent of the clutching assembly comprised by member 10, tube 12, nuts 31 and 33, and washer 34. The nut 35 is normally disengaged. Washer 34 can be made of an antifriction material such as nylon or any combination thereof so as to permit the rotation of said washer 34 relative to the spring 36.

What I claim is:

1. A mechanically adjustable support column comprising:

(a) a support tube having a mounting cylinder telescopically mounted in an open end thereof in axially adjustable relation thereto;

(b) a threaded support rod mounted in axially fixed, rotatable relation to said support tube;

(c) an energy storing spring means connecting one end of said support rod with the end of said support tube opposite said open end, whereby energy is stored in said energy storing spring means responsive to rotation of said support rod; and biases said support rod to a first position;

(d) connecting means mounting said mounting cylinder on said threaded support rod in said axially adjustable relation between a first extended position when said support rod is in said first position and a selected second one of a plurality of partially retracted positions wherein said spring means is in an energy storing position, said connecting means comprising:

(i) a first threaded drive nut engaging said threaded support rod and movable axially in response to axial movement of said mounting cylinder whereby axial movement of said mounting cylinder from said extended position is translated into rotation of said support rod through said drive nut;

(ii) a locking means for locking said drive nut at a selected retracted position; and (e) clutch means operable from outside said mounting cylinder for locking said drive nut in said selected position.

2. The support column according to claim 1 wherein said energy storing spring means comprises a spirally wound power spring having one end secured to said support rod and the other end connected to said support tube.

3. The support column according to claim 1 wherein said threaded support rod comprises a "diamond thread" along at least a portion of its length.

4. The support column according to claim 3 wherein said locking means of said connecting means comprises a threaded locking nut having threads formed therein opposite to the threads of said drive nut, whereby frictional engagement of said locking nut with said drive nut prevents rotation of said support rod in either direction, said clutch means including an activating means having a handle protruding outwardly of said mounting cylinder for selectively separating said drive nut and said locking nut when adjustment is desired.

5. The support column according to claim 1 and further including a thrust bearing operably connected between said support tube and said mounting cylinder, whereby said mounting cylinder may be rotated or swivelled with respect to said support tube without disturbing the longitudinal adjustment setting.

6. The support column according to claim 1 wherein said support tube includes a support washer secured to the lower end thereof, said support washer including a central opening therein through which the lower end of said support rod freely extends for rotatable movement therein, and a securing means attaching said support rod to said support washer in such a way as to allow rotation, but impede longitudinal displacement of said support rod relative to said support washer.

7. The support column according to claim 4 wherein said connecting means comprises, in addition to said first threaded drive nut, a second internally threaded drive nut axially spaced from said first drive nut and engaging said threaded support rod, said locking means comprising an internally threaded locking nut between said first and second drive nuts engaging said threaded rod and being threaded in the reverse direction of the threads in said first and second drive nuts.

8. The support column according to claim 7 wherein the rotation of said first drive nut is prevented when the locking nut frictionally engages the surface of said first drive nut, and the selective engagement between the surfaces of said first drive nut and said locking nut being controlled by said clutch means.

9. The support column according to claim 4 wherein a compression spring normally biases said locking nut into surface engagement with said first drive nut.

10. The support column according to claim 5 wherein said thrust bearing comprises a plurality of cooperating belleville washers operatively connecting said mounting cylinder and said connecting means.

11. The support column according to claim 9 wherein said compression spring is seated on a lower end plug across the diameter of said mounting cylinder, said end plug being substantially circular in cross section and having a threaded peripheral wall mating with internal threads on the inner wall of the lower end of said mounting cylinder, whereby the threaded relation between said plug and said mounting cylinder provides for adjustment in the tension of said compression spring and thus the frictional force of said drive nut and locking nut.

12. The support column according to claim 1, wherein said mounting cylinder is provided with a tapered upper portion and said tapered upper portion includes an end wall to prevent the axial displacement of elements internal to said mounting cylinder and said tapered upper portion of said cylinder constitutes part of frictional engaging means with a matching tapered bore on the underside of an article to be mounted thereon.

13. The support column according to claim 1, wherein said support rod is provided on one end with a shoulder, said shoulder having essentially a non-circular cross section, a bearing member having a centrally located bore receiving said shoulder, insuring the simultaneous rotation of said bearing member and said support rod about their longitudinal axis.

14. The support column according to claim 13, wherein said bearing member is provided with means to engage one end of an energy storing spring means so as to cause the winding of said energy storing spring means upon the rotation of said support rod and said bearing member relative to said support tube.

15. The support column according to claim 14, wherein said support rod shoulder extends through the center of and beyond said energy storing spring means without contact therebetween.

16. The support column according to claim 14, wherein the other end of said energy storing spring means is engaged with yet another bearing member and said other bearing member is provided with means to engage said other end of said energy storing spring means.

17. The support column according to claim 16, wherein said other bearing member is provided with means on its periphery to engage said support tube so as to prevent the rotation of said other bearing member about its longitudinal axis and relative to said support tube.

18. The support column according to claim 17, wherein said other bearing member is provided with a central bore and said support rod shoulder extends for a distance without contact, through and beyond said central bore of said other bearing member.

19. The support column according to claim 18, wherein said support rod shoulder, said one bearing member, said energy storing spring means, and said other bearing member are located on one end of said support tube and prevented from axial displacement therein by abutment means on said one end of said support tube.

* * * * *

Notice of Adverse Decision in Interference

In Interference No. 102,021, involving Patent No. 4,613,106, L. E. Tornero, MECHANICAL ADJUSTABLE COLUMN, final judgment adverse to the patentee was rendered Mar. 9, 1989, as to claims 1-3 and 6.

[ *Official Gazette May 30, 1989* ]